US005775836A

United States Patent [19]

Dean, Jr.

[11] Patent Number: 5,775,836

[45] Date of Patent: Jul. 7, 1998

[54] CAPPING DEVICE FOR UNIFORM CAPPING OF SUBAQUATIC SEDIMENTS

[76] Inventor: Americo Dean, Jr., 645 Old Tecumseh Road East, R.R. No. 1, Belle River, Ontario, Canada, N0R 1A0

[21] Appl. No.: 610,738

[22] Filed: Mar. 5, 1996

[51] Int. Cl.[6] ..... F02D 15/10

[52] U.S. Cl. ..... 405/17; 405/223; 405/303

[58] Field of Search ..... 405/17–34, 222, 405/223, 303

[56] References Cited

U.S. PATENT DOCUMENTS

| | | | |
|---|---|---|---|
| 2,780,920 | 2/1957 | Silvert | 405/223 |
| 4,133,761 | 1/1979 | Posgate . | |
| 4,309,127 | 1/1982 | Jacobs . | |
| 4,344,722 | 8/1982 | Blais . | |
| 4,352,590 | 10/1982 | Parker et al. . | |
| 4,407,606 | 10/1983 | Larsen . | |
| 4,475,846 | 10/1984 | Nette et al. . | |
| 4,480,943 | 11/1984 | Leuenberger . | |
| 4,518,280 | 5/1985 | Fletcher | 405/17 |
| 4,828,432 | 5/1989 | Ives . | |
| 5,146,996 | 9/1992 | Gainer, Jr. . | |
| 5,150,986 | 9/1992 | Rohr | 405/223 |
| 5,222,839 | 6/1993 | Ishida et al. | 405/223 X |
| 5,265,976 | 11/1993 | Russell . | |

FOREIGN PATENT DOCUMENTS

| | | | |
|---|---|---|---|
| 3717198 | 12/1988 | Germany | 405/17 |
| 208516 | 10/1985 | Japan | 405/223 |
| 169528 | 7/1986 | Japan | 405/17 |
| 233322 | 10/1987 | Japan | 405/17 |
| 40020 | 2/1988 | Japan | 405/17 |
| 40023 | 2/1988 | Japan | 405/17 |
| 125418 | 5/1989 | Japan | 405/223 |
| 161611 | 7/1991 | Japan | 405/17 |

*Primary Examiner*—Tamara L. Graysay
*Assistant Examiner*—Frederick L. Lagman
*Attorney, Agent, or Firm*—Ridout & Maybee

[57] ABSTRACT

A capping vessel and method for the low-turbidity delivery of a desired depth of capping materials to the sediment surface of a body of water along a predetermined course, the vessel comprising at least one floatable platform; a plurality of generally vertically submerged tremies comprising an array, the array of tremies depending from the at least one platform and extending to a predetermined height above the sediment surface, for the delivery of capping material to the sediment surface; at least one delivery hopper for the apportioning and feeding of capping material to the array of tremies; at least one rotary feeder interposed between the array of tremies and the delivery hopper for delivering the capping material to the array of tremies at a controlled rate; rotation control means for controlling the rate of rotation of the at least one rotary feeder in predetermined relationship to the forward velocity of the platform and the desired depth of capping material; and navigation control means for controlling individually the position of the vessel and the velocity of the vessel along the predetermined course. The vessel further provides means for the deposition of a geotextile prior to capping, and is adapted to permit the laying of over-lapping geotextiles simultaneously with the capping thereof. The apparatus can be used stand-alone or in conjunction with a mother vessel.

18 Claims, 9 Drawing Sheets

CAPPING DEVICE FOR UNIFORM CAPPING OF SUBAQUATIC SEDIMENTS

TECHNICAL FIELD

The invention relates to the in situ laying of capping materials on contaminated sub-aquatic sediments, and more particularly to a method and device for ensuring the deposition of a uniform thickness of capping material without undue perturbation of the contaminated sediment.

BACKGROUND OF THE INVENTION

Sub-aquatic contaminated sediments represent a potential long-term source of pollutants to the environment. Various approaches, such as dredging, have been used for the treatment of contaminated sediments, but they are expensive and are of limited value. Containment of the contaminated sediment by in-situ capping is an alternative to dredging and has an immediate benefit to the environment in that the sediment is isolated from benthic and aquatic organisms. Further, the transport path between the contaminated zone and the aquatic ecosystem is substantially increased which reduces the affects of any bioturbation on re-suspension of the contaminated sediment. Additionally, the containment by means such as capping creates a generally anaerobic environment which permits natural degradation processes an opportunity to detoxify or destroy the contaminants.

However, to be effective, the capping layer must reach and maintain the desired thickness. While the thickness of a cap is dependant on many factors intimately associated with any given site, an accepted minimum cap depth is approximately one-half metre. Many methods can be used to place a cap for containing highly toxic marine sediments, but often times, the nature, or more specifically, the chemistry and specific gravity of the identified constituents within the sediment column lend themselves to rapid re-suspension when agitated. During deposition of a capping layer, any agitation of the toxic constituents which occurs during the deposition of the capping layer must be avoided or the subsequent resettlement of the toxic material afterwards may negate the effects of the containment cap.

Among some of the methods currently used are surface release from barges, along with controlled release from split-hull barges. Alternatively, the capping material may be pumped by pipeline and either released at the surface or below surface. Direct mechanical placement may used and effected either from barge or from shore. Another method is to use a swing-tremie with submerged release. While each of these approaches is capable of placing a cap, there is limited or no control over the thickness or uniformity of the cap and accordingly, large increases in cap thickness and targeted area must be called for in order to ensure that the minimum cap depth is maintained over the site.

When dealing with certain contaminants, it has been considered desirable to lay a sheet of geotextile fabric or membrane prior to capping the sediment in order to substantially isolate the contaminated sediment from contact with benthic plants which could otherwise incorporate the toxic material into its tissues. In systems to date, laying of a geotextile is a separate operation from capping and as a consequence, brings with it alignment problems and the costs associated with a two pass system, thereby dissuading the use thereof.

Various methods currently in use, and their drawbacks, are discussed in Dredging '94, Proceedings of the second International Conference on Dredging and Dredged Material Placement, published by the American Society of Civil Engineers. Further information is found in the U.S. Army Corps of Engineers Misc. Paper D-86-6 entitled "Survey of Equipment and Construction Techniques for Capping Dredged Material" by Sanderson and McKnight.

SUMMARY OF THE INVENTION

Accordingly, the present invention provides a capping vessel for the low-turbidity delivery of a desired depth of capping materials to the sediment surface of a body of water along a predetermined course, the vessel comprising at least one floatable platform; a plurality of generally vertically submerged tremies comprising an array, the array of tremies depending from the at least one platform and extending to a predetermined height above the sediment surface, for the delivery of capping material to the sediment surface; at least one delivery hopper for the apportioning and feeding of capping material to the array of tremies; a rotary feeder interposed between the array of tremies and the delivery hopper, for the controlled delivery of the capping materials to the array of tremies; means for controlling the rate of rotation of the feeder in predetermined relation to the forward velocity of the platform and the desired depth of capping material; and navigation control means for controlling individually the position of the vessel and the velocity of the vessel along the predetermined course.

In a further embodiment the capping vessel further comprises detector means disposed to the aft of the tremie array, the aft detector means detecting the sediment depth and cross-section thereof after the laying of the capping material and providing the information thus detected to the capping vessel; means for adapting the information from the aft detector to control the rate of revolution of the feeder, and means for adapting the information from the aft detector for the navigation control means for controlling the velocity of the vessel, so as to maintain a predetermined relationship between the rate of rotation of the rotary feeder and the velocity of the vessel whereby the capping material depth is maintained at a predetermined depth along the predetermined course.

In a further embodiment the capping vessel further comprises roll support means for supporting a roll of containment membrane thereon; means for disposing the roll support means at a predetermined elevation proximate the sediment and to the fore of the array of tremies; and control means for effecting the controlled unrolling of said containment membrane at a predetermined rate.

In a yet further embodiment the present invention provides the roll of membrane laterally offset relative the array of tremies.

The present invention provides a method for delivering a substantially uniform depth of capping material to a selected portion of the sediment surface of a body of water, the method comprising the steps of providing capping material to a hopper in operative communication with at least one rotary feeder, the at least one rotary feeder being in operative communication with an array of vertically submerged tremies depending from a capping vessel operable to be moved over the selected portion of the sediment surface along a predetermined course; causing the at least one rotary feeder to rotate at a predetermined rate relative to the desired depth of capping required and the velocity of the capping vessel; and causing the capping vessel to move along the predetermined course while delivering the desired depth of capping material to the sediment surface.

The present invention further provides a method for delivering a membrane to the sediment surface of a body of water and covering the membrane with a substantially uniform depth of capping material along a predetermined course, the method comprising the steps of providing capping material to a hopper in operative communication with at least one rotary feeder, the rotary feeder being in operative communication with an array of vertically submerged tremies depending from a capping vessel adapted for controlled movement along a predetermined course; providing a roll of membrane material on a roll means disposed to the fore of the array of tremies and proximate the sediment surface, the roll means adapted to unroll the membrane at a predetermined controlled rate; unrolling the membrane from the roll at a predetermined rate and anchoring the leading edge thereof to the sediment surface; rotating the at least one rotary feeder at a predetermined rate relative to the desired depth of capping required and the velocity of the capping vessel; and causing the capping vessel to move along the predetermined course so as to lay the membrane and provide a capping thereto substantially simultaneously.

The present invention yet further provides a method for delivering a substantially contiguous overlapping membrane to an area comprising the sediment surface of a body of water and covering the membrane with a substantially uniform depth of capping material over the area, the method comprising the steps of providing capping material to a hopper in operative communication with a plurality of rotary feeders, each of the rotary feeders being in operative communication with an associated tremie of an array of vertically submerged tremies depending from a capping vessel, the capping vessel adapted for controlled movement along a predetermined course; providing a roll of membrane material on a roll means disposed proximate the sediment surface to the fore of the array of tremies and laterally offset therefrom a predetermined amount, the roll means adapted to unroll the membrane at a predetermined controlled rate; unrolling the membrane from the roll at a predetermined rate and anchoring the leading edge thereof to the sediment surface; rotating the at least one rotary feeder at a predetermined rate relative to the desired depth of capping required and the velocity of said capping vessel to thereby feed capping material to the array of tremies for delivery to the membrane surface; causing the capping vessel to move along a first predetermined course over the area to be covered, so as to lay the membrane and provide a capping thereto substantially simultaneously, whereby the membrane is substantially covered save the edge in the offset direction; causing the capping vessel to move along subsequent predetermined courses over the area to be covered, wherein each of said subsequent courses is laterally displaced a predetermined width from the first course and repeats the step of the first course; and wherein during the last of the subsequent courses, no membrane is laid, and predetermined tremies of the tremie array provide capping material to the offset edge of the last laid membrane to seal the edge thereof.

BRIEF DESCRIPTION OF THE DRAWINGS

The invention will be more clearly understood with reference to the following detailed specification read in conjunction with the drawings, in which.

DESCRIPTION OF THE PREFERRED EMBODIMENTS

While the present invention is directed primarily to the isolation of highly toxic sediments which are readily re-suspended upon perturbation of the sediment, the present invention is readily adapted to many different situations where it is desired to distribute a relatively uniform cap of material onto an existing sediment, using capping materials such as dredged clean sediment, sand or fine gravel, and is also readily adapted to distribute other materials such as bio-remediators or chemical agents, either alone or in conjunction with the capping material.

In a first embodiment, the present invention comprises a sediment capping device disposed on a floatation platform such as a barge or similar type of marine vessel, to be pushed or towed by a hopper dredge or similar mother vessel which supplies both deposition materials and the control functions therefor, and is adapted to provide a continuous layering of a substantially uniform predetermined depth of capping material over a strip of submerged sediment, without undue perturbation of the sediment. In a second embodiment, the capping device is adapted to contiguously deposit strips of a containment membrane such as a geotextile, with or without predetermined width of overlap without undue perturbation of the sediment, prior to depositing the required depth of cap. In a third embodiment the present invention comprises a capping vessel, incorporating both the first and second capping device embodiments, and certain portions of the mother vessel functions.

Figure 1:
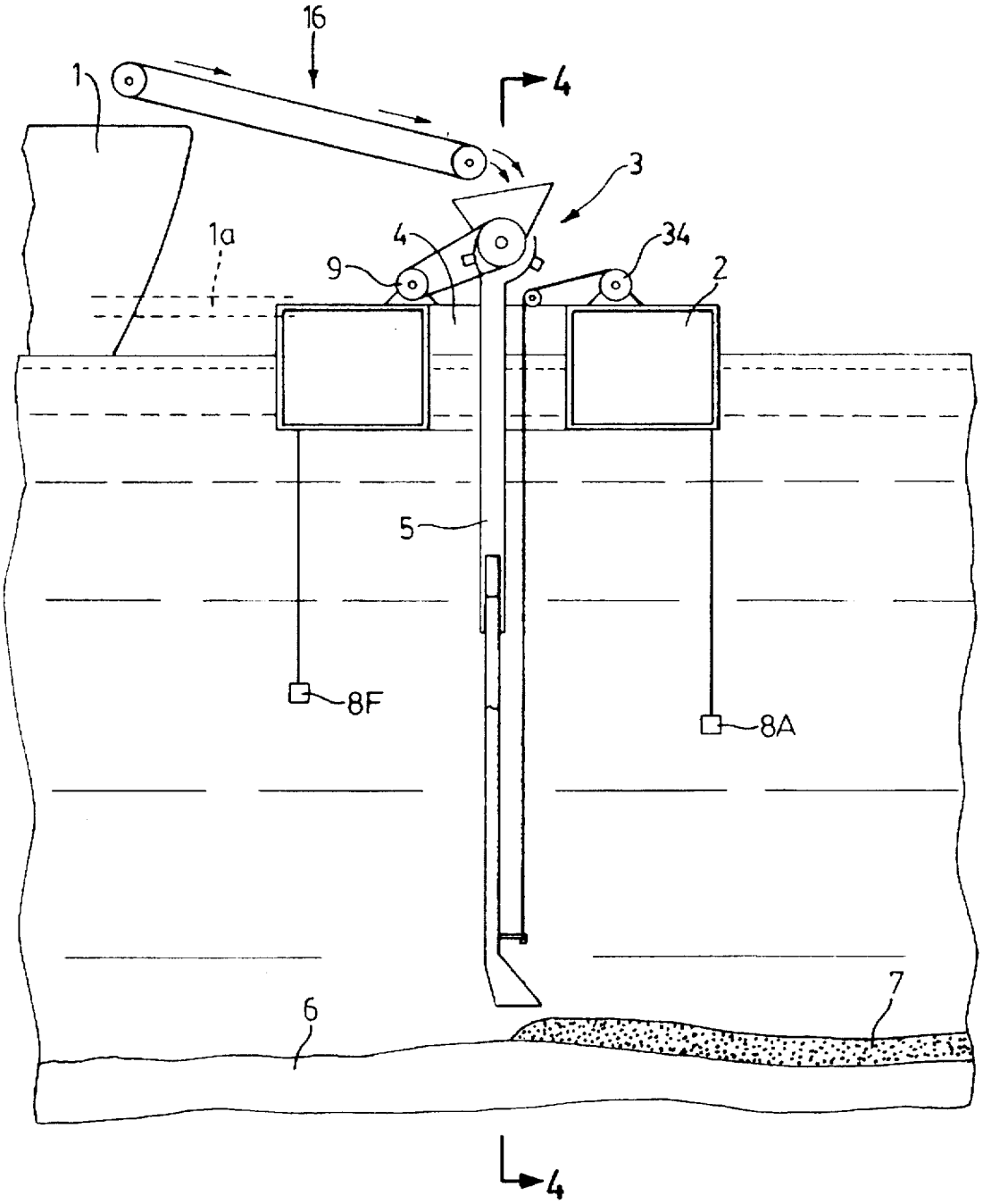
FIG. 1 is a side elevational view of one embodiment of the capping vessel of the present invention.

Referring to FIG. 1 which shows the first embodiment, there is provided behind a mother vessel 1, a flotation platform 2, in the form of a barge. In operation, the platform 2 is located at a known position and attitude relative to the mother vessel, by means of a harness la and may comprise several individual floatation units linked together. Located proximate the middle of the floatation platform 2 so as to distribute the load thereof, a material feeder system 3 is disposed over a delivery opening 4. Vertically suspended in the delivery opening 4 below the feeder system 3 and in operable communication therewith, is a tremie unit 5 comprising a plurality of tremies 5*a*. Material received from the mother vessel 1, such as sand, is delivered by any one of known material transfer systems 1*b* to the feeder system 3 which provides it at a controlled rate to the tremie unit 5 and where it is subsequently deposited over the existing sediment 6 in the form of a layer or cap 7. At the rear of the platform 2 is located a post-deposition depth monitor $8_A$ which is used to provide information regarding the thickness of the just deposited cap to the mother vessel 1. The mother vessel 1, which will be described in greater detail later, provides control information which is used to control both the rate at which the feeder system 3 provides capping material to the tremie unit 5, and the height of the lower end of the tremie unit 5 above the sediment 6 by means of adjustment means 34. The platform has on board motor or engine means 9 coupled to the feeder system.

Figure 2:
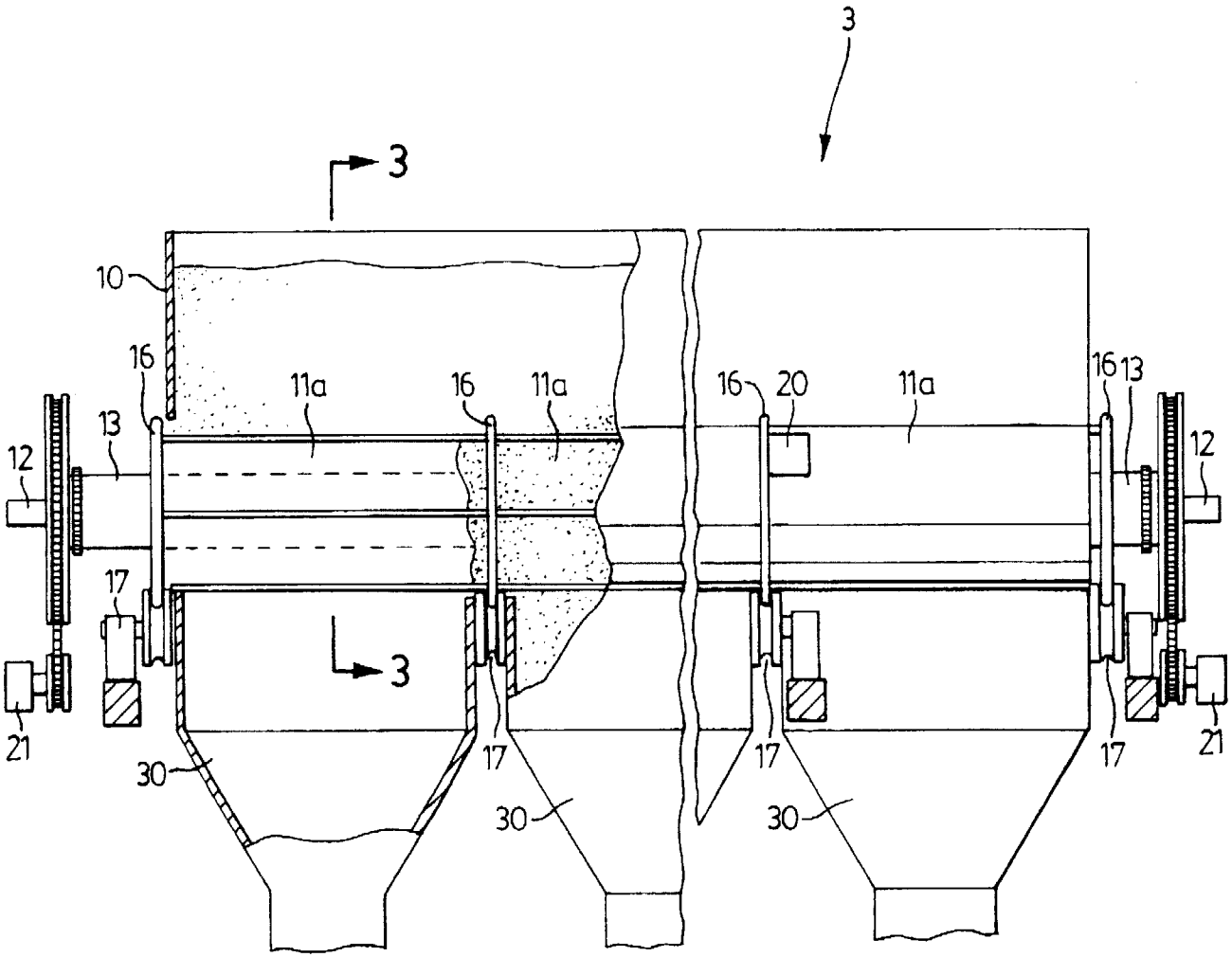
FIG. 2 is a partial sectional detail view showing the feed mechanism for the tremies.
Figure 3:
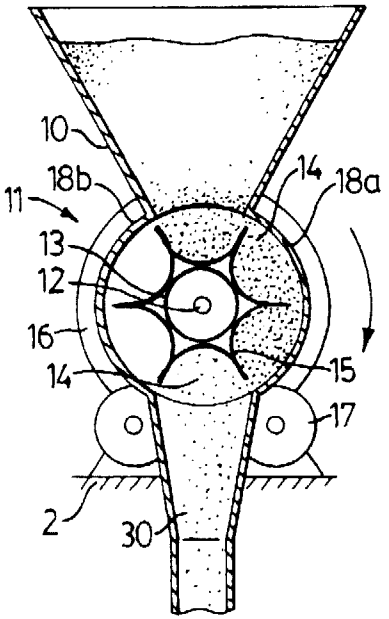
FIG. 3 is a cross-sectional view along line 3—3 of FIG. 2.

FIGS. 2 and 3 shows in greater detail the material feeder system 3, which is a controlled advance volumetric feeder and comprises a hopper 10 which apportions capping material to a series of horizontally oriented rotary feeders 11 mounted on a common drive shaft 12. Each rotary feeder 11*a* comprises a horizontal cylinder 13 disposed on and affixed to the shaft 12, and has a plurality of volumetrically equal troughs 14, formed on the outer periphery thereof. Preferentially there are six radial troughs 14, and using more troughs, rather than fewer, is preferred. The walls 15 of the troughs 14 can be formed by plates radiating from the cylinder 13 outward. Alternatively, the troughs 14 can be formed as substantially semi-circular flutes on the cylinder 13, thus providing curved trough walls 15. Such curved trough wall (and floor) 15 surfaces act to prevent a build-up of material, such as damp sand, which would interfere with achieving the required capping depth. While shown herein as linear, the troughs 14 can spiral about the cylinder 13, such spiralling serving to smooth the feed of material and further, reduce the peak-load power requirements. The length of each of the rotary feeders 11*a* corresponds to the width of an associated tremie 5*a*. The endwalls of each of the rotary feeders 11*a* are also preferably curved inward to the floors of the respective troughs. Projecting radially beyond the extent of the trough walls 15, the load-bearing endwalls 16 are provided to each side with rolling bearing supports 17.

While shown here as being a common wall between sections, the walls 16 can be separate to each section and releasably connected to each other, such as by means of bolts, to aid in the overall rigidity of the unit. Located to each side of the junction of the hopper 10 and rotary feeder 11 are cowlings 18*a* and 18*b*. The post-loading cowling 18*a* serves to retain the capping material in the loaded trough 14 until it is substantially inverted and the capping material drops into a funnel 30 below, and to that end conforms to the circumference of the cylinder until proximate the 4 to 5 o'clock position when it diverges to communicate with the funnel 30 and allows material to start leaving the trough 14. The pre-loading cowling 18*b* prevents material being loaded into one trough from spilling out into the following empty trough and then out. The cowlings 18*a* and 18*b* are removable to permit service access when required. When the troughs 14 are spirally disposed, appropriate adjustment to the shape and extent of cowlings 18*a* and 18*b* can be made.

When it is expected that the material to be placed may be damp or somewhat adherent to the troughs, each section of the rotary feeder 11 can be provided with vibratory or impacting means 20, such as those known in the art, acting to impact or vibrate the end walls 16 so as to assist in the release of any material adhering to the inverted trough. The impacting means 20 can be powered by electric, air, hydraulic or mechanical means and are preferably provided with control means to provide both variable impact frequency and variable impact force. Should impacting means not be provided, a risk occurs that the actual volume of material deposited will fall below that required, resulting in a cap having a reduced depth.

Variable speed shaft drive means 21, such as a variable displacement hydraulic motor or electric motor, is coupled to the shaft 12 in known fashion and is controlled by signals from the mother vessel 1. Depending upon the length of the shaft 12 and the volume of the troughs 14, shaft drive means 21 are provided at both ends of the shaft, and adapted to work in unison.

Figure 4:
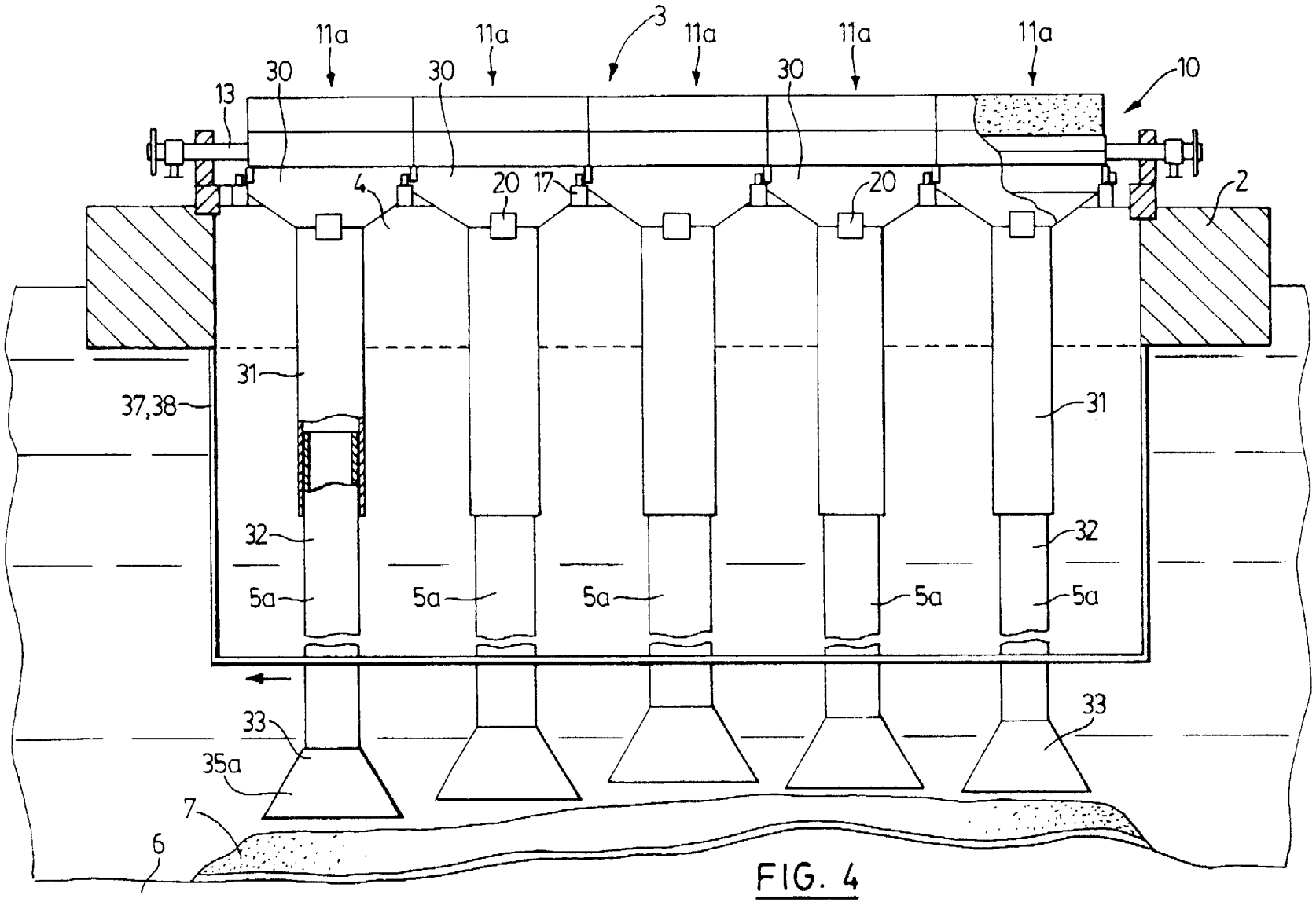
FIG. 4 is a partial cutaway rear elevational view of the embodiment shown in FIG. 1 taken along line 4—4.
Figure 5:
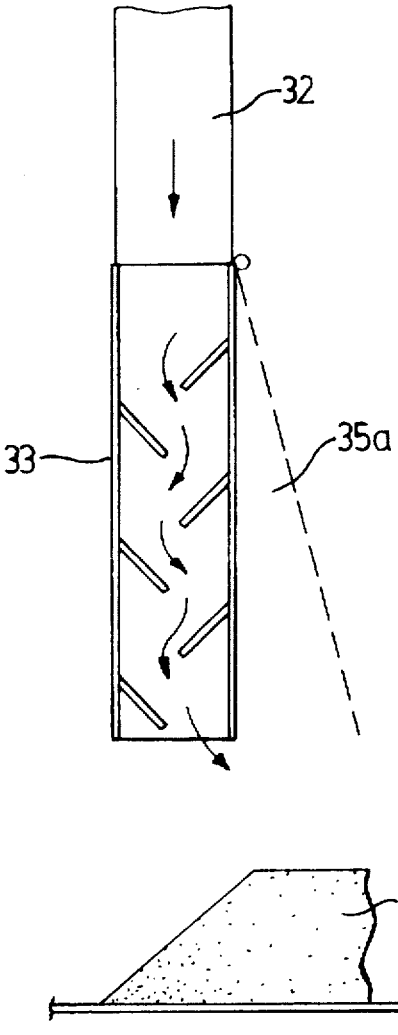
FIG. 5 is a partial sectional detail view of a diffuser for a tremie.
Figure 6:
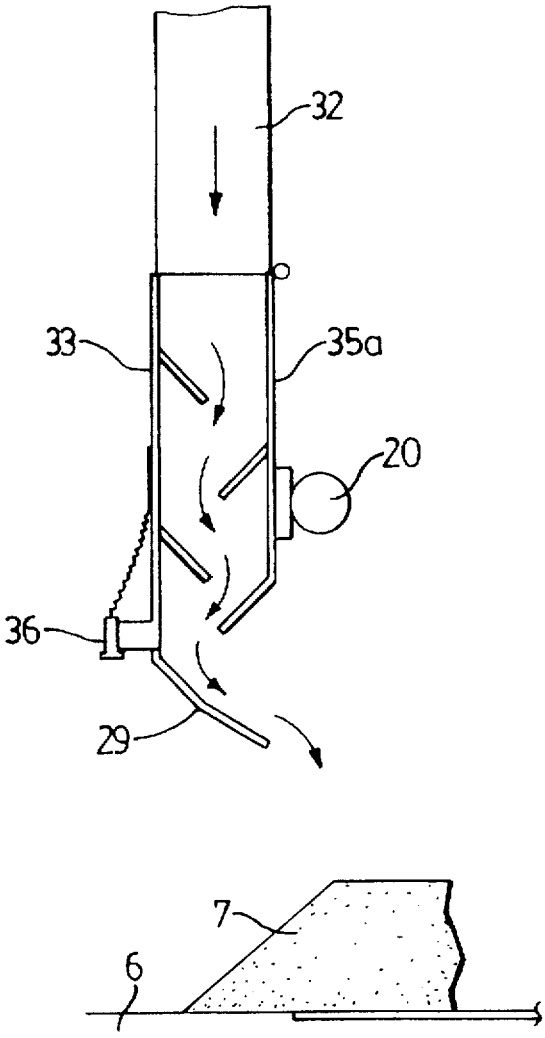
FIG. 6 is an alternative to the diffuser shown in FIG. 5.
Figure 7:
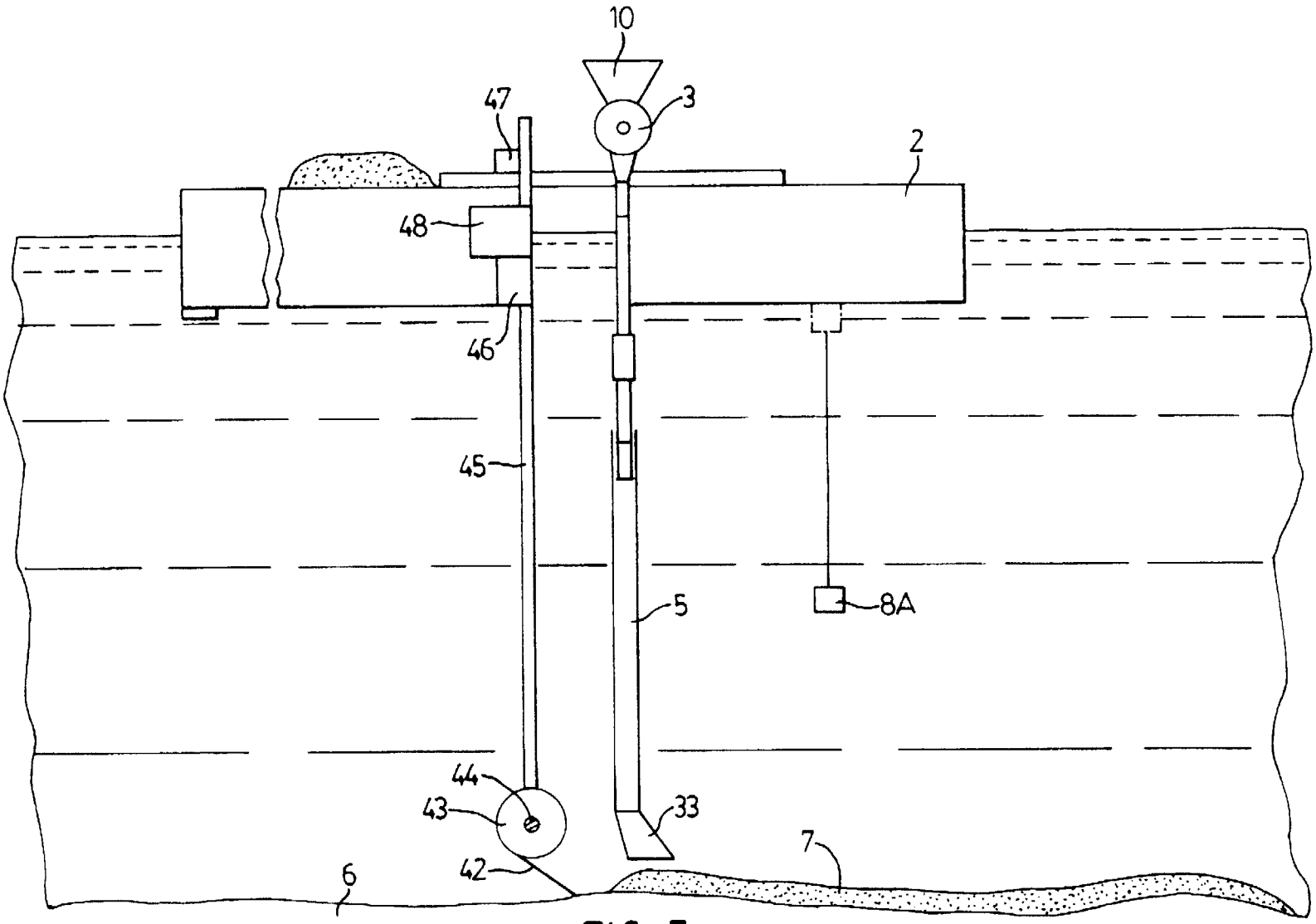
FIG. 7 is a side elevational view of an alternative embodiment of the capping vessel of the present invention.
Figure 8:
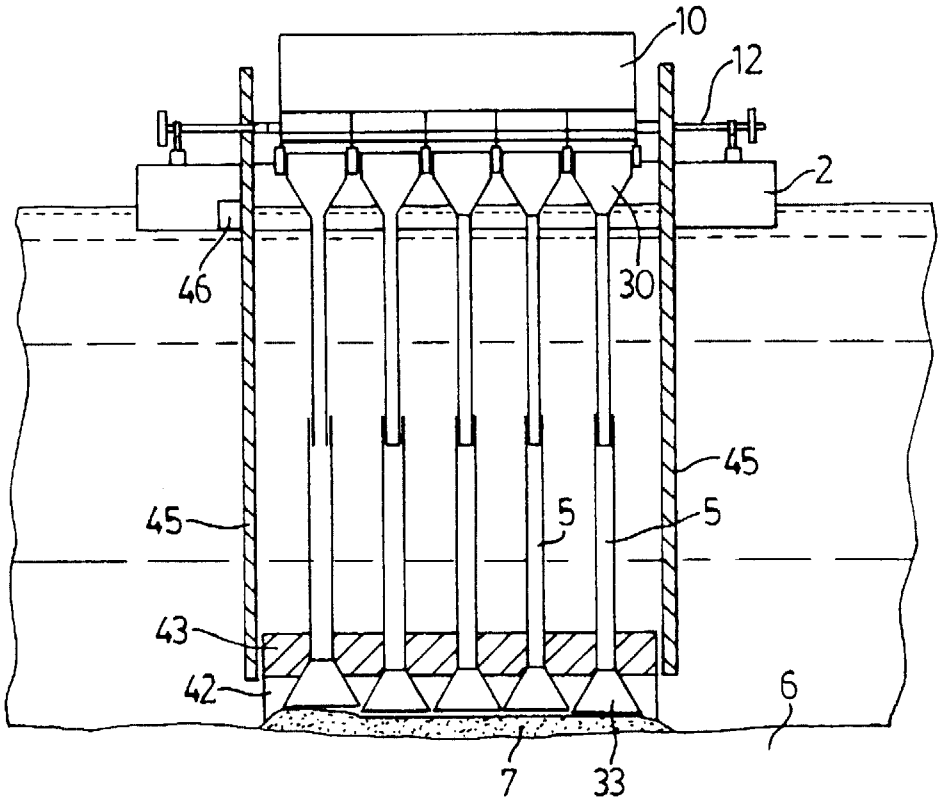
FIG. 8 is a rear elevational view of the embodiment shown in FIG. 7.

Referring now to FIGS. 4, 5, and 6 there is shown a cross-sectional view of the capping device taken along a line through the array of tremies 5. For simplicity, the construction of one tremie 5*a* of the tremie unit 5 will be discussed and such discussion is typical to each of the tremies of the array. Disposed immediately below the feeder system 3 in the delivery opening 4, the tremie 5*a* receives the capping material from a trough 14 of an associated feeder 11*a* and directs it downward. The tremie 5*a* comprises an upper funnel portion 30, at least one fixed-length pipe section 31, with preferably a second pipe section 32 working in controlled extensible relationship with the fixed pipe section 31, and terminates in a detachable diffuser 33 section. To prevent damming of the capping material within the funnel 30 of the tremie 5*a*, the funnel 30 can be adapted to be an elongate cone provided with an impacting device 20 disposed at the funnel-pipe junction. The diameter selected for the tremie pipe 31, and extension 32 if used, should be determined relative to the maximum depth of capping desired to be achievable per unit time. Alternatively, a set diameter can be used with subsequent limits on feeder 11 rotation rates and the maximum forward velocity of the vessel.

The height of the extensible tremie 5*a* is vertically adjustable by adjustment means 34 (see FIG. 1) which serves to raise and lower the second pipe section 32 as required, with the movement effected by, for instance, hydraulic, pneumatic, or mechanical systems. A system employing a bi-directionally controlled spool of cable can be used. In this way, during forward travel of the platform 2, and in response to control signals from at least one depth monitor $8_F$ at the fore of the platform 2, the length of the tremie 5*a* can be adjusted to maintain a predetermined distance from the sediment 6 surface. Disposed at the delivery or output end of the tremie 5*a*, the diffuser 33 serves to evenly diffuse the capping material over the width of sediment 6 addressed by the individual tremie 5*a*. The diffuser 33 is adapted to be detachable from the tremie pipe 32 thus permitting the use of diffusers 33 modified in keeping with the desideratum of differing site conditions and capping materials. The diffuser 33 is further provided with at least one hinged side 35 to permit inspection, cleaning, and plug removal. Additionally, the diffuser 33 can be provided with impacting means 20, and appropriate power and control means therefor, to assist in reducing the occurrence of damming in the tremie 5*a*.

In capping projects where a containment membrane has not been, and is not being deployed, the diffuser 33 serves to both slow the impact speed of the capping material and to simultaneously direct it preferentially towards cap material already deposited, which serves to decrease any turbulence and subsequent mixing of the cap material and sediment which might otherwise occur. To this end, the diffuser 33 has appropriately placed internal baffle plates 35 angularly installed, as best shown in FIGS. 5 and 6. FIG. 6 shows the leading edge 29 of a diffuser 33 rearwardly directed to direct the falling capping material to already placed capping material. Each tremie 5*a* can further be provided with an independent depth monitor 36 so that at all times the depth of the diffuser 33 is independently known. This reduces the chances of inadvertent ploughing and damage to the diffuser 33 and tremie 5*a* if an erroneous reading is provided by adjustment means 34. The depth monitor 36 and adjustment means 34 may be integrally formed yet independently operative components.

Dependent upon the construction used to form the tremies 5*a* and the tremie unit 5, a brace means 37 can be provided thus allowing for longer tremies to be used without consequent reduction in potential forward speed of the vessel due to drag-induced stress on the tremies 5*a*. Under certain conditions, such as substantive depths to the sediment, brace means 37 can be formed as an integral part of the adjust means 34 provided for the tremie unit 5. Accordingly, light-weight substantially rigid plastic piping, such as polypropylene can be used for the tremies 5*a*, reducing the overall cost of fabrication, and the load on the platform 2. When substantive lengths are involved for both pipes 31 and 32, the cross-section of the pipes can be modified to be that of an oval or tear-drop, thus assisting in the reduction of drag and the subsequent stress on the tremie 5*a*.

It should be noted that an alternative positioning of the material feeder system disposes the rotary feeder 11-tremie unit 5 junction at a position just above that of the water. This positioning reduces to a minimum the height to which capping material has to be elevated to be placed in the hopper 10.

To assist in the maintenance of the tremie unit 5 and to assist in pre-deposition manoeuvrability of the device, the tremie unit 5 can be adapted to be submerged and withdrawn by depending the tremie unit 5 on a movable support arrangement 38 which can also act as the brace 37 means. Thus to either move the capping vessel to the deposition zone, or to effect maintenance on the tremies 5*a*, the tremie unit 5 can be conveniently withdrawn from the water. Accordingly, the upper funnel portion 30 is adapted to be unitary with the rotary feed 11, which is in turn adapted to be displaceable such that it can be moved from above the tremie unit 5, at which time the support arrangement 38 withdraws the tremie unit 5 from the water. The post-deposition depth monitor $8_A$ provides a depth-to-sediment reading the full width of the tremie unit 5 and, under certain capping conditions, can extend further to either side. The depth monitor $8_A$ may be of the side-scan sonar type, or of the narrow beam echo sounder type and, if of the latter, preferably with a beam of 15° or less. The monitor $8_A$ can comprise an array of discrete devices of only one type, or can comprise a combination of discrete devices of both types. Alternatively, other depth or profile determining devices may also prove to be suitable for use. In positioning the monitor $8_A$ behind the tremies 5*a*, sufficient distance must be provided so as to ensure that erroneous readings are not generated therefrom. When desirable, the aft depth monitor $8_A$ or array thereof can be beneficially suspended at a predetermined depth below the platform 2 to reduce the potential for erroneous readings.

With reference now to FIGS. 7–10, in a further embodiment the capping device is adapted to deploy a containment membrane 42 onto the sediment 6 surface prior to the deposition of the cap 7. In addition to preventing plant root contact with the contaminated sediment, the use of geotextile membranes offers further mechanical advantages. When deployed prior to the cap 7, the membrane 42 also functions to prevent turbulent mixing of the sediment 6 with the cap 7 so that effectively, the entire cap depth seals the sediment and not only the upper, unmixed portion of the cap as would otherwise be. Further, when dealing with very soft or semi-liquid type sediments, the use of the membrane 42 will prevent punching through of the cap material into the sediment 6. In both of these circumstances, the use of a geotextile can reduce the required depth of cap thus providing material savings, along with greater assurance that the sediment will not come into contact with aquatic or benthic organisms.

When a membrane 42 is to be applied prior to the deposition of the cap 7, a length of membrane 42 equivalent to the proposed run is wrapped onto a support roll 43 which is affixed to a roll shaft 44 which is mounted at either end on supports 45. Primary anchoring means such as rebar, concrete weights, etc. are preferably applied across the free end of the membrane 42 prior to its submersion and the free end of the membrane 42 is left long enough to ensure that the anchoring means reach the sediment 6 at such time as the roll 43 is submerged to its working depth. The roll support 43 is lowered from the platform 2 to a predetermined working depth above the sediment 6, by means of the supports 45 which are under control of a support moving means 46 to a depth which is monitored by a support height monitor 47. The support moving means 46 can be hydraulic, pneumatic, electrical or mechanical in nature and further effects a locking action on the support when not moving the support. The support height monitor can be electrical or mechanical in nature and provides a signal to the capping control system. It is preferable that the distance between the sediment 6 and the lower edge of the roll 43 be as small as possible so as to keep the angle of attack to a minimum. If the angle of attack becomes too large because the distance between the sediment 6 and the lower edge of roll 43 is too great, the membrane 42, which can have a width in excess of 30 feet or more, will begin to behave as a sail, and thereby cause sufficient turbulence ahead of the membrane that the sediment could be adversely disturbed causing undesirable resuspension of toxic material.

To assist in deployment of the membrane, the support roll 43 is initially unwound by way of controllable power means 48 adapted to rotate the roll shaft 44 for a short predetermined distance until such time as sufficient cap material 7 has been deposited to anchor the membrane 42 to the sediment 6 surface. Dispersed membrane monitor 49, which comprises a revolution counter adapted to a wheel driven by the passing membrane 42, provides information as to the length of membrane 42 that has been dispersed. When this point is reached, powered unwinding of the roll support 43 can be discontinued, and the power means 48 disengaged from the roll shaft 44 thus permitting the roll shaft 44 to rotate freely in response to the membrane 42 tension. Alternatively, continuous powered unrolling of the membrane 42 will be particularly advantageous if the selected membrane is fairly thin or subject to stretching, or if a downhill gradient is encountered. Powered unrolling of the membrane will assist in preventing stress to the membrane 42 due to the weight of capping material on the unsupported membrane portion and reduce undo sloughing or avalanching of the capping material at such time as the membrane would otherwise settle.

Figure 9:
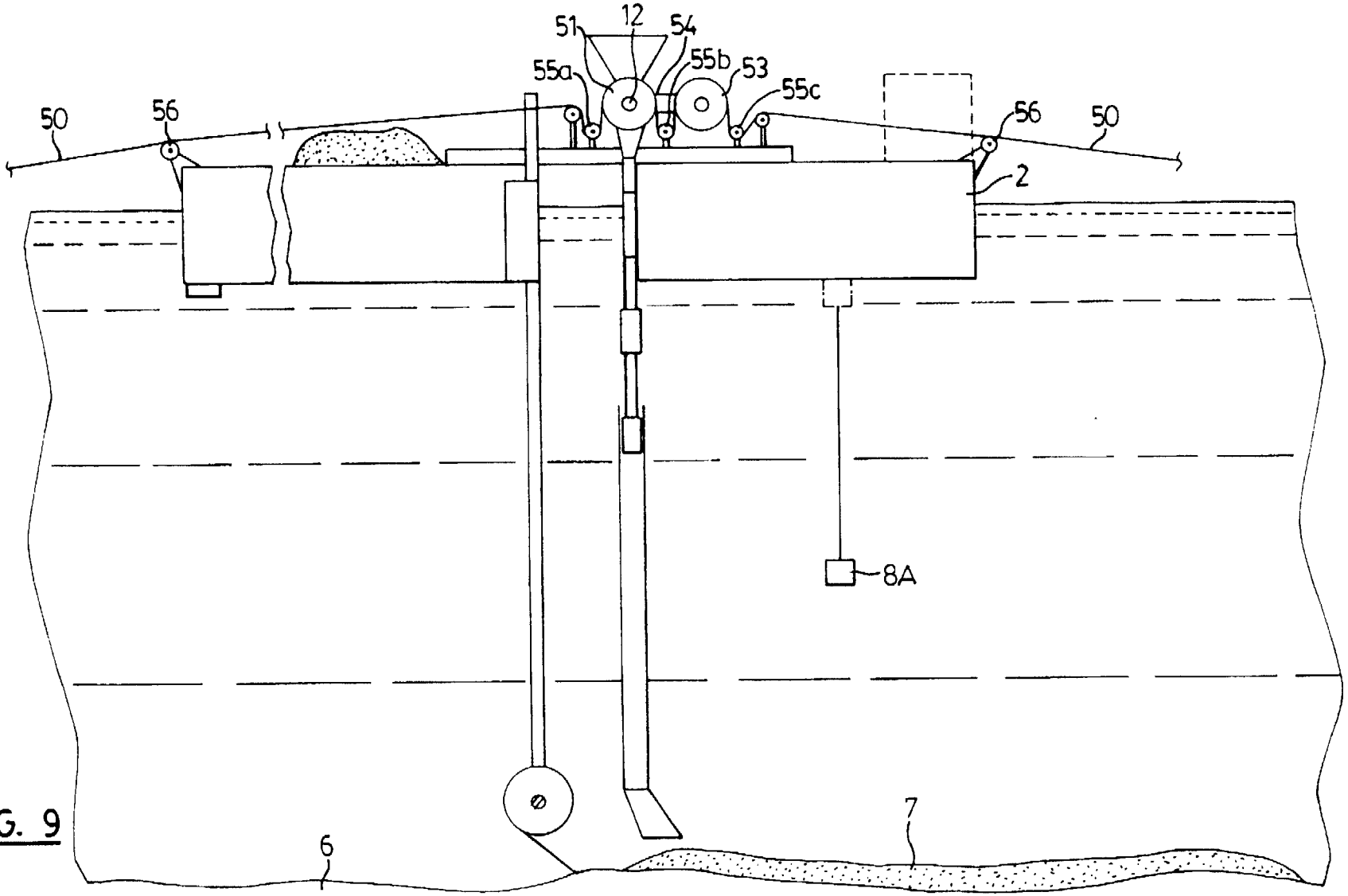
FIG. 9 is a side elevational view of a further alternative embodiment of the present invention.

In a further embodiment, shown in FIG. 9, the platform 2 is guided by means of a set of parallel traction/mooring cables 50 which define an area to be capped and which can further define a series of sequential strips to be capped. Forward movement means for the vessel can be provided by tug or onboard power plant. Disposed at appropriate locations on the vessel 2 are bow thrusters 52 adapted to provide omni-directional thrust control used to keep the travel of the vessel 2 in substantial alignment with the traction/mooring cables 50.

Disposed on both sides of the vessel 2 and replacing the shaft driving means 21 are traction sheaves 51 adapted to engage the traction/mooring cables 50. In this fashion, forward movement of the vessel 2 along cables 50 effects a predetermined rate of rotation of the traction sheave 51 and the rotary feeder shaft 12. The volume of each trough 14 is predetermined, and the number of troughs 14 required to achieve the required depth of cap 7 per unit of travel is determined and translated to an appropriate traction sheave 51 diameter. Accordingly, the rate at which material is deposited can be effected by changing the effective radius of the traction sheave 51. As the rotary feeder 4 is not powered except by the forward movement of the vessel 2 along the traction cable 50, a second traction sheave 53 is provided and coupled to the first sheave 51 by means of a chain 54 for sharing the load. This cable driven system is further provided with a set of appropriately disposed idler sheaves 55*a*, 55*b* and 55*c* and fairleads 56. This embodiment represents a generalized version of a drive approach and could be configured in many ways. One such configuration can provide the rotary feeder shaft 12 driven by a variable displacement hydraulic motor 21 which is in turn driven by the traction sheave 51, wherein the ratio between the traction sheave 51 and rotary feeder shaft 12 is adjustable. This embodiment is readily adapted to incorporate the membrane depositing apparatus as disclosed above.

A yet further embodiment of the present invention is particularly useful in the laying of over-lapping strips of membrane 42, allowing relatively large contaminated areas to be effectively and accurately sealed and capped. The ability of the present invention to both place and cap the membrane substantially simultaneously, provides significant reductions in expense of both time and money in the formerly two-step membrane-capping procedure with substantially higher quality.

In this embodiment of the vessel, the feeders 11*a* are adapted to be controllably rotatable independently of each other. The respective cylinders 13 of the feeders 11*a* are mounted upon and adapted to rotate freely on the shaft 12, and each feeder 11*a* is provided with an independent motor means 21, with a capping control system 70 providing independent control signals therefor.

In this embodiment of the vessel, one of the supports 45 is adapted to be out-rigged from the support platform 2, and the roll shaft 44 is extended a comparable amount. Further, the support roll 43 is adapted to be predeterminedly laterally displaceable along the roll shaft 44 by displacement means 25, which may be hydraulic, pneumatic, or mechanical in nature. The extent of out-rigging is adjustable to the desiderata of the site, but will tend fall into the range of 25% of the total width of the diffusers 33 of the tremie unit 5, when the membrane 42 width is equal to the total width of the diffusers of the tremie unit. Under conditions of substantial cap depth or slump, the range may increase to as much as 50% of the membrane width. Alternatively, the roll support shaft 43 and supports 45 are adapted to be laterally disposable as a unit with respect to the tremie unit 5, and remaining substantially parallel thereto.

Figure 10:
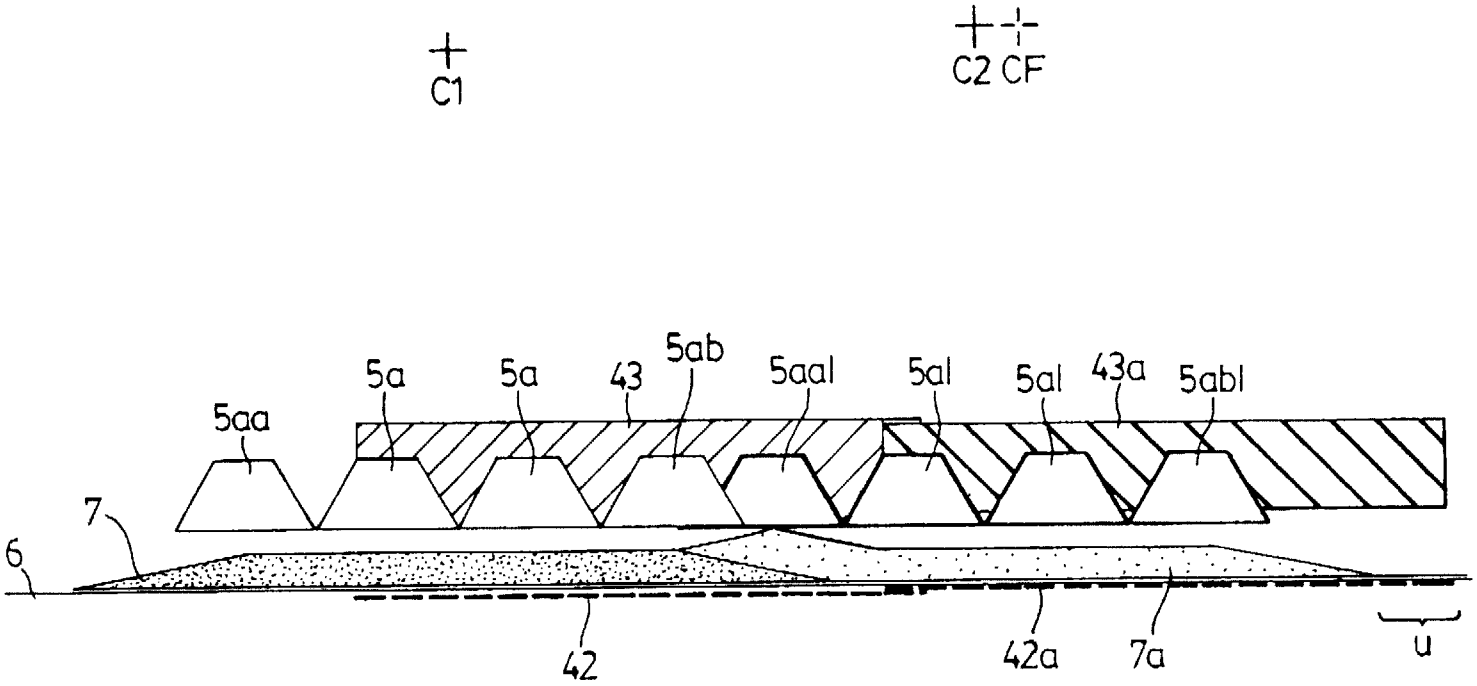
FIG. 10 is a rear elevational view of an overlap membrane pass overplaying a method of the present invention.

Shown in FIG. 10, is a rear elevational view of two passes of an over-lapping run with the preferred embodiment, wherein the direction of travel of the vessel is into the page, and the overlapping of the membrane is proceeding to the right. For clarity, the membrane 42, 42A is shown in heavy dashed lines. Deployment can just as readily occur to the left, should it be desired. In this drawing only the diffuser of each tremie is shown for clarity and is labelled as, and is to be taken as, representing the entire tremie 5*a* thereof and the associated independently controllable feeder 11*a*. It is further assumed that the user will initiate deposition of the cap 7 somewhat earlier than deploying the membrane 42 at the start of a run, and continue deposition of the cap 7 somewhat after the end of the membrane 42, as detected by a dispersed membrane monitor 49, such that both the starting and ending edges of the membrane 42, 42A have a region of cap 7 extending therebeyond. This portion of the cap 7 serves to both anchor and protect the edge of the membrane 42.

In this example, which for the sake of simplicity only comprises a two-membrane wide region, a first membrane strip 42 has been deposited on the contaminated sediment 6 and provided with a cap 7 by means of tremies 5*aa*, 5*a*, and 5*ab* during the first pass. The center of the line of travel C1 of the tremie unit 5 during the first pass is fixed at the outside edge of the region to be isolated and capped. The support roll 43 has been displaced to a position proximate the vertical centre-line of a first tremie 5*a* taking in to account the cap thickness, cap slump, and degree of membrane overlap desired. The laying of the membrane 42 and the subsequent capping proceeds substantially as indicated previously. Since the membrane 42 is now offset from the tremie array 5, the thus deposited cap 7 does not cover the full width of the membrane 42, but leaves a predeterminedly wide strip U of the membrane 42 to the right of right-most tremie 5*ab* uncovered. Dependant upon the slump of the material being used for the cap 7 and the desired depth of the cap 7, along with other considerations such as navigational accuracy, the rotation rate of feeder 11*a* for tremie 5*ab* is throttled back to aid in increasing the width of the strip U. Further control over the width of strip U is effected by providing a diffuser attitude flap 39 adapted as the outer most wall of the diffuser portion of tremie 5*ab*. Deployment of the attitude flap 39 to a substantially vertical position, in conjunction with a reduced rate of rotation of the associated feeder 11*a*, and the degree of offset of the support roll 43 produces an un-capped region of substantially controllable width. The flap 39 can be fixed in position prior to submersion of the tremie 5*a*, or be provided with movement means 40 under control of the capping control system 70 to allow adjustment while submerged, thus allowing a degree of ongoing flexibility in controlling the width of the cap.

Turning to the second pass, the center of the line of travel C2, is somewhat less that one full offset CF which is an offset from C1 equal to the overall width of the diffusers of the tremie array of the tremie unit 5. The offset O distance is the width of membrane overlap desired. In most conditions, no change will need to be made in the position of the support roll 43 on the roll shaft 44. As the second pass proceeds, the second membrane 42*a* portion is deposited from the roll support 43*a* onto the sediment 6 such that a portion of it overlaps onto the uncovered portion of the membrane 42. The degree of over-lap will depend upon factors such as accuracy of vessel deployment, and the degree of lateral displacement of support roll 43*a*, which are under control of the user at such time. It is noted that in some cases the amount of over-lap will be nil, such as when being used to prevent punching through of the cap 7 material, and in some cases, such as with extremely toxic or mutagenic contaminants or a well developed bioturbator population, substantive overlap widths may be called for. The present embodiment is readily adaptable to provide either. In other cases, such as with deep cap depths or a locally depleted local bioturbator population, it may be permissible and nondetrimental that some depth of capping material may occur between the over-lap portions. A television camera and lighting can be suspended from a position immediately in front of the left edge of the roll support 43 and be used to provide visual information for real-time manual control over the position of the roll 43 on the roll shaft 44, thus allowing visual confirmation and control over the degree of overlap being achieved.

During the second pass, the left-most tremie 5*aa*1 will generally provide sufficient capping material to cover the portion of the membrane 42a which overlaps the membrane 42 and, in some cases where this may not occur, adequate maintenance of the minimum cap 7a depth can be achieved by driving the associated rotary feeder 11a providing capping material to the left-most tremie 5aa1 at a predetermined increased rate. The degree of over-driving desired can be determined at the time with information provided by the aft depth sensor $8_A$, and effected by means of capping control system 65.

The final pass in the over-lap process, which has not been illustrated in this figure, does not require the deployment any membrane, but does require that at least the left-most tremie 5aa2, and in this example, the tremie 5a2 immediately beside it, provide sufficient capping material such that the resultant cap strip extend beyond the right-most edge of the membrane 42a, so as to anchor and protect the right-most edge of the last membrane strip 42a.

The above method can be readily carried out with any desired number of repetitions of the second step without any change to the first and last steps.

Figure 11:
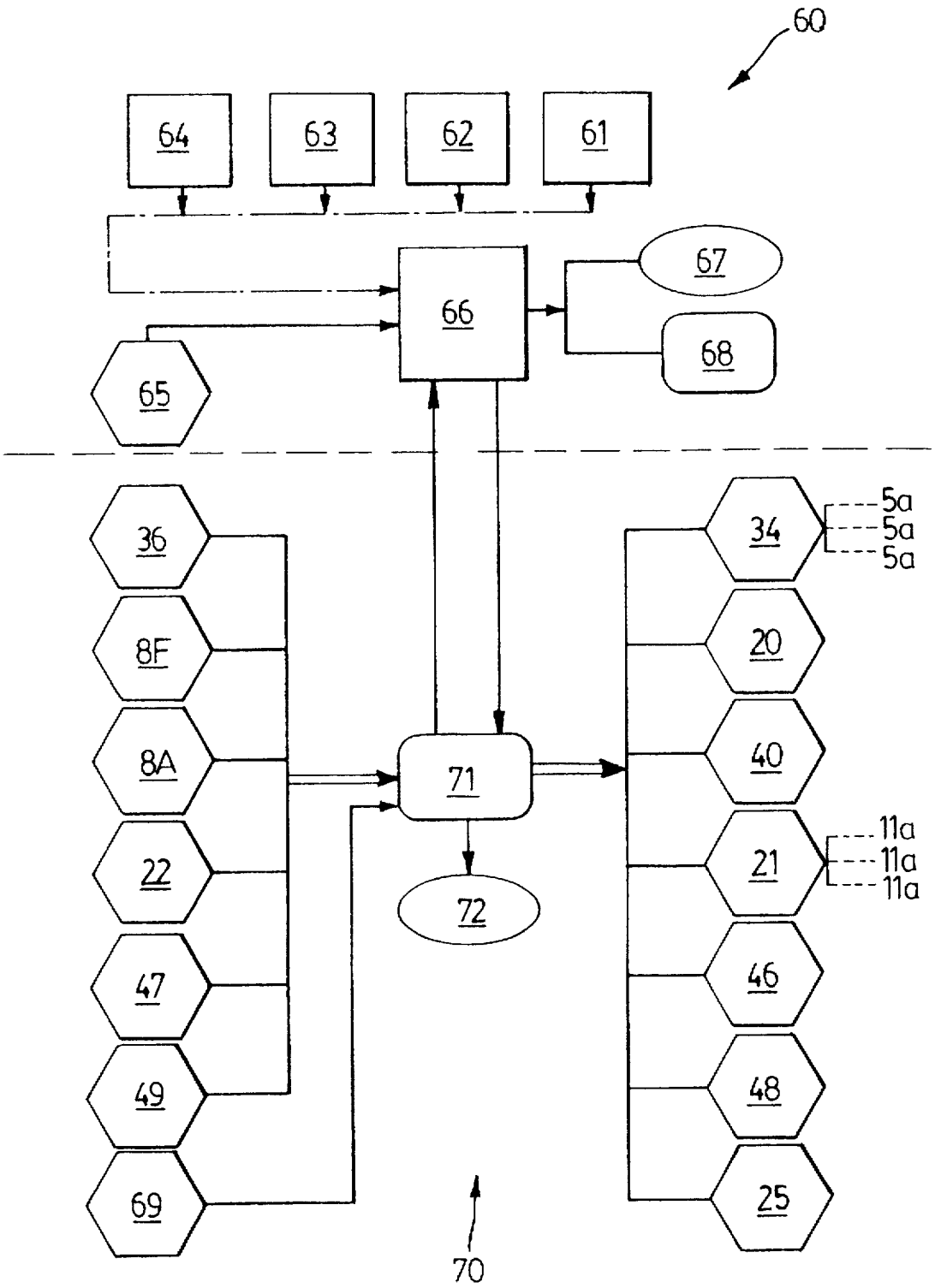
FIG. 11 is a schematic of a control system of an embodiment of the present invention.

Turning now to FIG. 11, there is shown in schematic an example of the preferred embodiment of the vessel control system 60 maintaining control over all aspects of the positioning operation and the capping control system 70 which maintains control over all aspects of the capping operation. The feeder system 3, tremie unit 5, and membrane roll 43 and their associated elements required for the laying of the cap and membrane will be referenced in the upcoming as the "capping device". The term "capping device" as defined is not meant to exclude use of the capping functions alone.

As noted previously, the mother vessel 1, which can be either an independent vessel or the floatation platform 2 itself adapted to support the same essential features, provides the positioning and control functions for the capping device, and provides the capping material. It is considered that a detailed hydrographic survey map 61 of the area to be capped has been undertaken and is available digitally to the vessel control system 60. It is preferred that tide height readings and vessel draft readings are obtained an ongoing basis from tide gauge monitors and vessel draft monitors and are provided to the mother vessel 1, as a water level signal 62, from which the elevation of any portion of the vessel or the capping device can be determined.

Data output from the fore detector $8_F$ and aft detector $8_A$ provided to the mother vessel 1, when combined with the mother vessel 1 fixed geometry and fitted to the stored hydrographic map 61, can be used to determine the mother vessel 1 position, attitude, and velocity. Ship navigation and control systems, such as the DredgeTrak™ offered by Entek Engineering of Vancouver Canada, can provide information regarding the forward tracking velocity, and vessel attitude to within centimetres, when hydrographic maps 61 are not present. Alternatively, optical positioning systems such as the HYDRO II™ portable hydrographic survey system can also be used to provide vessel position information to within acceptable parameters. When a system similar to the DEL NORTE Model 4012 by DEL NORTE Technology, Inc. of Euless Texas is used, since the three dimensional position of the ship can be accurately determined, and if the capping device is an independent vessel and its relative position with respect to the mother vessel is known, a profile of the sediment the capping device is over or just coming upon can be obtained from the hydrographic survey data. The above noted systems, and those similar, provide to the vessel positioning system 66 not only data 63 with respect as vessel to location, elevation, course, and velocity but data 64 as to corrected location, elevation, course and velocity. Also available to the vessel positioning system 66, can be a gyro compass signal 65 providing the ship heading in case of navigation system failure. Under conditions such as when a substantial period of time has elapsed since the taking of the survey, or when the sediment profiles have changed sufficiently, or when hydrographic data 61 is not available, the mother vessel 1 can alternatively, via the above-noted data 63, 64, and 65, provided to the vessel positioning system 66, obtain a real-time profile of the upcoming sediment 6 below the capping device by means of the forward depth monitor $8_F$ suspended in front of the capping device, thus ensuring real-time sediment depth and profile data for the capping process. The vessel positioning system 66 provides to the operator the current status of the vessel by means of a vessel control display 67, and provides control functions to the automated vessel control 68 which controls the bearing, the attitude, and the speed of the mother vessel.

The capping control system 70 comprises data inputs from the capping device, a capping controller 71, and the controls over the individual operating elements of the capping device. The capping controller 71 translates the desired capping depth, the status of the capping device, and the cap 7 that has been laid, to calculate the changes required as the capping device moves forward over the changing sediment 6 profile. The capping controller 71 is in operative communication with the vessel positioning system 66 and can receive information regarding the sediment 6 profile, along with other data as required, therefrom. The capping controller 71 further outputs to visual display 72, which may be recorded, a visual indication of the process status for the operator, thus allowing visual feedback of the effect of any change introduced by the operator, and the efficacy of the controller program.

The height at which the tremie unit 5 or of the individual tremies 5a and the associated diffusers 33 are disposed above the sediment 6 is obtained by the capping controller 71 and compared with the hydrographic map 61 or data from the fore detector $8_F$. Changes in elevation of the tremie unit 5 or tremies 5a to maintain a predetermined height above the sediment 6 surface that may be required because of changes in the sediment 6 profile are effected by the capping controller by way of tremie vertical adjustment means 34. The actual rotation rate of the rotary feeder or feeders 3 is obtained from the feeder shaft rotation detector 22, and the capping controller 71 provides the feeder shaft drive means 21, which controls several discrete rotary feeders 11a, appropriate signals with respect to any required changes in speed, as calculated by deviations in the desired cap 7 depth as determined from signals from the aft detecting means $8_A$. The capping controller 71 further provides the under-drive/overdrive control signals to the shaft drive means 21 for certain tremies of the tremie unit 5 during overlap membrane runs, as well as the flap 39 control signals. The capping controller 71 can, if desired, be provided with instructions to keep impacting means 20 active and provide the appropriate control signals to the impacting means 20 during all capping operations, or to effect such only under predetermined circumstances.

During membrane 42 deposition, information as to the current depth of the supports 45 is obtained from support height monitor 47, compared to the upcoming sediment 6 profile, and a control signal provided to support moving means 46 to move the supports 45 to an appropriate elevation. Information obtained from the dispersed membrane monitor 49, along with membrane support 43 dimensions, are used by the capping controller 71 to accurately determine the true clearance between the constantly changing diameter of the membrane 42 on the support roll 43 and the sediment 6 surface, and accordingly adjust the elevation of the support roll 43 via spud moving means 46 so as to maintain the desired height and angle of attack of the membrane 42, and as length-of-run and end-of-membrane signals.

Provided to the capping controller 71 via data input system 69, which can comprise a keyboard, and disc or tape reading device, or stored program data, is amongst other parameters, the thickness of the cap 7 to be deposited, and the fixed volumetric value of the rotary feeder 11 or feeders 11*a*, ie. the volume per trough 14 or per revolution of a given cylinder 13, the degree of membrane support roll 43, feeder overdrive limitations. This is translated by the capping control system 71 into the number of revolutions of the rotary feeder 11 required per unit linear distance traversed by the capping device relative to the forward velocity of the capping device, and this output is used to control variable drive means 21 to provide the desired capping depth. When, for instance, the required change in feeder 11 rotation exceeds predetermined limits, the capping controller 71 outputs a control signal to the vessel positioning system 65 to adjust the forward rate of the vessel. In this way, the capping device is able to maintain the cap 7 at the desired thickness with a minimum of human control. The pre- and post-deposition readings are recorded and can be saved for post-construction analysis and long-term monitoring of the site.

Under certain circumstances, it may be desired to provide a cap, not of predetermined thickness, but to a predetermined elevation. Under these circumstances, the water level signal 62 used in conjunction with the aft depth monitor $8_A$ signal can provide a control signal indicating the desired capping elevation, and any deviation therefrom.

As noted previously, the present invention is also adapted to depositing capping layers of material other than sand or gravel, such materials being bio-remediating in nature. Alternatively, the capping material can comprise a combination of several ingredients, with minor adaptations to compensate for the behaviour of the mixed ingredients.

Changes may be made in the combinations, operations, arrangements and steps of the various parts, elements and methods described herein without departing from the spirit and scope of the invention as defined in the following claims.

What is claimed is:

1. A capping vessel for the low-turbidity delivery of a desired depth of capping materials to the sediment surface of a body of water along a predetermined course, said vessel comprising:

at least one floatable platform;

a plurality of generally vertically submerged tremies comprising an array, said array of tremies depending from said at least one platform and extending to a predetermined height above the sediment surface, for the delivery of capping material to the sediment surface, wherein each tremie of said array of tremies is adapted to be extensible and is provided with means to effect the selective extension thereof;

a detector disposed to the fore of said platform for detecting the depth and profile of the sediment along the predetermined course of the platform, wherein said means for effecting the extension of each of said tremies is provided with controlling information from said fore detector;

at least one delivery hopper for the apportioning and feeding of capping material to said array of tremies;

at least one rotary feeder interposed between said array of tremies and said delivery hopper for delivering the capping material to said array of tremies at a controlled rate;

at least one rotation control means for controlling the rate of rotation of said at least one rotary feeder in predetermined relationship to the desired depth of capping material and the velocity of the vessel; and navigation control means for controlling individually the position of the vessel and the velocity of the vessel along the predetermined course.

2. A capping vessel according to claim 1, further comprising aft detector means for detecting the capping depth and cross-section thereof after the laying of the capping material.

3. A capping vessel according to claim 2, wherein said vessel further comprises:

means for adapting information from said aft detector to control the rate of revolution of said at least one rotary feeder, and to said navigation control means for controlling said velocity of said vessel, whereby a predetermined relationship between the rate of rotation of said rotary feeder and the velocity of said vessel is maintained so that the capping material is layed down at a predetermined depth along the predetermined course.

4. A capping vessel according to claim 3, wherein said at least one rotary feeder comprises a plurality of rotary feeders each adapted to communicate with an associated tremie of said tremie array; and wherein each of said plurality of rotary feeders is provided with independent control means for controlling the rate of rotation of each rotary feeder of said plurality of rotary feeders.

5. A capping vessel according to claim 2, wherein said aft detector means comprises at least one discrete detector chosen from the group consisting of side-scan sonar detectors and narrow beam echo sounders.

6. A capping vessel according to claim 1, wherein said vessel further comprises membrane deploying means for disposing a membrane on a sediment surface prior to capping said membrane, said membrane disposing means comprising:

roll means for supporting a roll of containment membrane thereon;

support means for disposing said roll means at a predetermined elevation proximate the sediment surface and to the fore of said tremie array; and means for effecting the controlled unrolling of said containment membrane from said roll at a predetermined rate; and means for monitoring the amount of membrane that has been deployed.

7. A capping vessel according to claim 6, wherein said spud means includes means for adapting information from said fore detector means to dispose said roll means at a predetermined elevation proximate the sediment surface.

8. A capping vessel according to claim 6, wherein said roll means is laterally displaceable with respect to said tremies.

9. A capping vessel according to claim 1, wherein said means for controlling the position and velocity of the capping vessel comprises a mother vessel adapted to have a fixed link to said capping vessel and provide control functions therefor.

10. A capping vessel according to claim 9, wherein said capping vessel is provided with means for receiving capping material from said mother vessel.

11. A capping vessel according to claim 1, wherein each of said tremies is further provided proximate the distal end thereof with baffle means for slowing the speed of the capping material prior to deposition.

12. A capping vessel according to claim 1, wherein each of said tremies is further provided at the distal end thereof with diffusing means for effecting substantially equal distribution of the capping material in a direction substantially parallel with said tremie array.

13. A capping vessel according to claim 12, wherein said diffusing means are further provided with directing means for preferentially directing the capping material toward previously deposited capping material.

14. A capping vessel according to claim 12, wherein said diffusing means of the outermost tremies of said array of tremies are each further provided with means for adjusting the lateral diffusion of the capping material in the outward direction.

15. A capping vessel according to claim 1, further comprising platform portions for the storage of capping material, and means for delivering the capping material from said platform to said delivery hopper.

16. A method for delivering a substantially uniform depth of capping material to a selected portion of the sediment surface of a body of water, said method comprising the steps of:

providing capping material to a hopper in operative communication with at least one rotary feeder, said at least one rotary feeder being in operative communication with an array of vertically submerged tremies depending from a capping vessel operable to be moved over said selected portion of the sediment surface along a predetermined course, wherein each tremie of said array of tremies is adapted to be extensible and is provided with means to effect the selective extension thereof;

detecting the depth and profile of the sediment along the predetermined course of the platform by means of a detector disposed to the fore of said platform, wherein said means for effecting the extension of each of said tremies is provided with controlling information from said fore detector;

causing the at least one rotary feeder to rotate at a predetermined rate relative to the desired depth of capping required and the velocity of said capping vessel; and causing said capping vessel to move along the predetermined course while delivering the desired depth of capping material to the sediment surface.

17. A method for delivering a membrane to the sediment surface of a body of water and covering said membrane with a substantially uniform depth of capping material along a predetermined course, said method comprising the steps of:

providing capping material to a hopper in operative communication with at least one rotary feeder, said rotary feeder being in operative communication with an array of vertically submerged tremies depending from a capping vessel adapted for controlled movement along a predetermined course, wherein each tremie of said array of tremies is adapted to be extensible and is provided with means to effect the selective extension thereof;

detecting the depth and profile of the sediment along the predetermined course of the platform by means of a detector disposed to the fore of said Platform, wherein said means for effecting the extension of each of said tremies is Provided with controlling information from said fore detector;

providing a roll of membrane material on a roll means disposed to the fore of said array of tremies and adapted to be proximate the sediment surface, said roll means adapted to unroll said membrane at a predetermined controlled rate;

unrolling the membrane from the roll at a predetermined rate and anchoring the leading edge thereof to the sediment surface;

rotating said at least one rotary feeder at a predetermined rate relative to the desired depth of capping required and the velocity of said capping vessel; and causing said capping vessel to move along said predetermined course so as to lay said membrane and provide a capping thereto substantially simultaneously.

18. A method for delivering a substantially contiguous overlapping membrane to an area comprising the sediment surface of a body of water and covering said membrane with a substantially uniform depth of capping material over the area, said method comprising the steps of:

providing capping material to a hopper in operative communication with a plurality of rotary feeders, each of said rotary feeders being in operative communication with an associated tremie of an array of vertically submerged tremies depending from a capping vessel, said capping vessel adapted for controlled movement along a predetermined course;

providing a roll of membrane material on a roll means disposed and adapted to be proximate the sediment surface to the fore of said array of tremies and laterally offset therefrom a predetermined amount, said roll means adapted to unroll said membrane at a predetermined controlled rate;

unrolling the membrane from the roll at a predetermined rate and anchoring the leading edge thereof to the sediment surface;

rotating said at least one rotary feeder at a predetermined rate relative to the desired depth of capping required and the velocity of said capping vessel;

causing said capping vessel to move along a first predetermined course over the area to be covered, so as to lay said membrane and provide a capping thereto substantially simultaneously, whereby the membrane is substantially covered save the edge in the offset direction;

causing said capping vessel to move along subsequent predetermined courses over said area to be covered, wherein each of said subsequent courses is laterally displaced a predetermined width from said first course and repeats the step of the first course; and wherein during the last of said subsequent courses, no membrane is laid, and predetermined tremies of said tremie array provide capping material to the offset edge of the last laid membrane.

* * * * *